US010859228B2

(12) United States Patent
Lim et al.

(10) Patent No.: US 10,859,228 B2
(45) Date of Patent: Dec. 8, 2020

(54) VARIABLE HEADLAMP APPARATUS FOR VEHICLE

(71) Applicants: HYUNDAI MOTOR COMPANY, Seoul (KR); KIA MOTORS CORPORATION, Seoul (KR); SL Corporation, Daegu (KR)

(72) Inventors: Jung Wook Lim, Seoul (KR); Byoung Suk Ahn, Gwacheon-si (KR); Ki Hong Lee, Seoul (KR); Seung Hyeok Chang, Suwon-si (KR); Jung Hee Seo, Gyeongsan-si (KR); Ji Yeon Kim, Gyeongsan-si (KR); Yoo Jin Son, Daegu (KR); Jong Young Kim, Daegu (KR); Jin Sik Nam, Gyeongsan-si (KR); Dong Hyun Go, Gyeongsan-si (KR); Mi Hyang Park, Daegu (KR)

(73) Assignees: HYUNDAI MOTOR COMPANY, Seoul (KR); KIA MOTORS CORPORATION, Seoul (KR); SL CORPORATION, Daegu (KR)

( * ) Notice: Subject to any disclaimer, the term of this patent is extended or adjusted under 35 U.S.C. 154(b) by 0 days.

(21) Appl. No.: 16/685,487

(22) Filed: Nov. 15, 2019

(65) Prior Publication Data

US 2020/0339033 A1 Oct. 29, 2020

(30) Foreign Application Priority Data

Apr. 26, 2019 (KR) ..... 10-2019-0049311

(51) Int. Cl.
*F21S 41/657* (2018.01)
*F21S 41/143* (2018.01)
(Continued)

(52) U.S. Cl.
CPC ..... *F21S 41/635* (2018.01); *F21S 41/295* (2018.01); *F21S 41/657* (2018.01)

(58) Field of Classification Search
CPC ..... B60Q 1/124; B60Q 1/06; B60Q 1/072; B60Q 1/076; B60Q 1/068; B60Q 1/122;
(Continued)

(56) References Cited

U.S. PATENT DOCUMENTS 4,991,063 A * 2/1991 Stoneham ..... F21V 13/04 362/18
5,459,955 A * 10/1995 Ruskouski ..... G09F 13/14 362/282
(Continued)

FOREIGN PATENT DOCUMENTS

DE 19709414 A1 * 10/1997 ..... F21S 41/689
DE 202014003078 U1 * 4/2014 ..... F21S 41/24
(Continued)

OTHER PUBLICATIONS

OSRAM, Optisches Element und Beleuchtungseinrichtung mit optischem Element, Apr. 17, 2014, English, DE202014003078U1 (Year: 2014).*
(Continued)

*Primary Examiner* — Bryon T Gyllstrom
*Assistant Examiner* — James M Endo
(74) *Attorney, Agent, or Firm* — Brinks Gilson & Lione

(57) ABSTRACT

A variable headlamp apparatus for a vehicle is capable of realizing various lighting functions by switching positions of the plurality of optical units only with a single drive unit. The variable headlamp apparatus includes: an optical unit having an emitter to emit light; a guide unit installed with the optical unit to guide a position of the optical unit to a fixed path; a link unit connected to the optical unit and including multiple links rotatably connected to each other to change
(Continued)

the position of the optical unit; and a drive unit to rotate the links. In particular, the optical unit moves along the fixed path of the guide unit while switching a light irradiation direction of the emitter.

9 Claims, 9 Drawing Sheets

(51) Int. Cl.
*F21S 41/63* (2018.01)
*F21S 41/29* (2018.01)

(58) Field of Classification Search
CPC .. B60Q 1/11; B60Q 1/115; F21S 41/19; F21S 41/24; F21S 41/29; F21S 41/295; F21S 41/395; F21S 41/63; F21S 41/635; F21S 41/67; F21S 41/675; F21S 41/65; F21S 41/657; F21V 14/02; F21V 14/025; F21V 14/06; F21V 14/065; F21V 17/107; F21V 17/18; F21W 21/30; F21W 21/108; F21W 21/116; F21W 21/26
See application file for complete search history.

(56) References Cited

U.S. PATENT DOCUMENTS 7,547,123 B2 * 6/2009 Kittredge ..... F21K 9/00 362/218
7,926,985 B2 * 4/2011 Teng ..... F21V 29/70 362/373
2001/0012205 A1 * 8/2001 Lassovsky ..... F21V 23/04 362/282
2009/0109670 A1 * 4/2009 Boyer ..... F21V 5/04 362/234
2009/0201681 A1 * 8/2009 Galke ..... F21S 2/00 362/249.07
2012/0217897 A1 * 8/2012 Gordin ..... F21V 5/04 315/294
2013/0286662 A1 * 10/2013 Zollers ..... F21V 5/004 362/336
2013/0329413 A1 * 12/2013 Cotta, Sr. ..... B60Q 1/0483 362/220
2015/0009699 A1 * 1/2015 Takii ..... B60Q 1/10 362/523
2016/0312989 A1 * 10/2016 Tiwary ..... F21V 21/30
2017/0038046 A1 * 2/2017 Bardot ..... F21V 21/30

FOREIGN PATENT DOCUMENTS

KR 10-2010-0069465 6/2010
WO WO-2012098142 A1 * 7/2012 ..... F21S 41/141
WO WO-2013042697 A1 * 3/2013 ..... F21S 41/689

OTHER PUBLICATIONS

Walter, Module for Projecting a Beam, Jul. 26, 2012, English, WO2012098142A1 (Year: 2012).*
Montet, Motor vehicle headlamp with optical strips, Oct. 30, 1997, English, DE19709414A1 (Year: 1997).*
Mochizuki, Light Distribution Control Mechanism for Impact-Driving Movable Optical Component, Mar. 28, 2013, English, WO2013042697A1 (Year: 2013).*

* cited by examiner

VARIABLE HEADLAMP APPARATUS FOR VEHICLE

CROSS REFERENCE TO RELATED APPLICATION

The present application claims priority to and the benefit of Korean Patent Application No. 10-2019-0049311, filed on Apr. 26, 2019, the entire contents of which are incorporated herein by reference.

FIELD

The present disclosure relates to a variable headlamp apparatus for a vehicle, which is capable of realizing various lamp functions.

BACKGROUND

The statements in this section merely provide background information related to the present disclosure and may not constitute prior art.

In general, a vehicle has a lighting system for making it possible to see objects in a traveling direction at night and for informing other vehicles or other road users of the traveling state of the vehicle. A headlamp, also known as a headlight, is a lamp that illuminates objects and roads ahead of the vehicle.

Such a headlamp provides various lighting modes such as a welcome light, a daytime driving beam, a nighttime driving beam, and so on. However, we have found that the number of components of the headlamp increases to provide the various lighting functions, and the headlamp also requires more space.

The foregoing is intended merely to aid in the understanding of the background of the present disclosure, and is not intended to mean that the present disclosure falls within the purview of the related art that is already known to those skilled in the art.

SUMMARY

In accordance with an aspect of the present disclosure, a variable headlamp apparatus for a vehicle includes: an optical unit having a emitter configured to emit light; a guide unit installed with the optical unit and configured to guide a position of the optical unit to a fixed path; a link unit connected to the optical unit and including a plurality of links rotatably connected to each other and to change the position of the optical unit based on a change to a rotation angle formed by links of the plurality of links; and a drive unit spaced apart from the guide unit, connected to the link unit, and transmitting rotational power during operation to rotate the links, wherein the optical unit moves along the fixed path of the guide unit while switching a light irradiation direction of the emitter.

The optical unit may include an optical casing installed with the emitter for emitting light, and a projection lens coupled to the optical casing and disposed in the light irradiation direction of the emitter so that an incident light thereon is emitted to the fixed path.

The projection lens may extend in the light irradiation direction of the emitter to have an end face, and may include an incident part on which light is incident from the emitter and an emission part from which light is emitted.

The emitter may be composed of a plurality of light emitting diodes (LEDs) arranged in a longitudinal direction of the optical casing. The incident part of the projection lens may be formed with a total reflection portion that is matched to each of the LEDs and protrudes in a direction facing the emitter to totally reflect incident light.

The emission part of the projection lens may have a plurality of optics formed thereon, and a switching portion may be recessed inward from the end face of the projection lens to switch a traveling direction of some incident light.

The optical casing may be provided with a connection bracket for allowing the projection lens to be connected integrally thereto. The connection bracket may have a guide protrusion protruding toward the guide unit. The guide unit may be formed with a guide path so that the guide protrusion is inserted into and slides in the guide path.

The guide path of the guide unit may have a first guide hole extending in a straight line, and a second guide hole spaced apart from the first guide hole and extending in a curved line with a radius of curvature in the extension of the first guide hole. The guide protrusion of the connection bracket may have a first protrusion inserted into the first guide hole and a second protrusion inserted into the second guide hole.

A first end of the second guide hole may be spaced apart from a first end of the first guide hole in a direction perpendicular to the extension of the first guide hole. A second end of the second guide hole may be disposed in the extension of the first guide hole and spaced apart from a second end of the first guide hole.

The link unit may include a first rotation link rotatably connected to the optical casing, and a second rotation link rotatably connected to the first rotation link and rotated by the rotational power transmitted from the drive unit.

The first rotation link may extend in a curved line at an obtuse angle, the second rotation link may extend in a straight line, and the first rotation link may have a length longer than the second rotation link.

The drive unit may include a motor that generates rotational power, and a screw that extends from the motor, is rotated by the rotational power transmitted thereto, and has a thread formed thereon. The second rotation link may have a rotary gear engaged to the thread of the screw.

The optical unit, the guide unit, and the link unit may be each provided in pair, which are spaced apart from each other, and the pair of link units may be connected to the single drive unit so that light irradiation directions of the respective optical units are simultaneously switched when the drive unit is operated.

As apparent from the above description, the variable headlamp apparatus for a vehicle having the above-mentioned structure can realize various lighting functions by switching the positions of the plurality of optical units only with the single drive unit, and achieve a reduction in manufacturing cost, a reduction in weight, and a reduction in entire layout since there is no need for a plurality of drive units.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
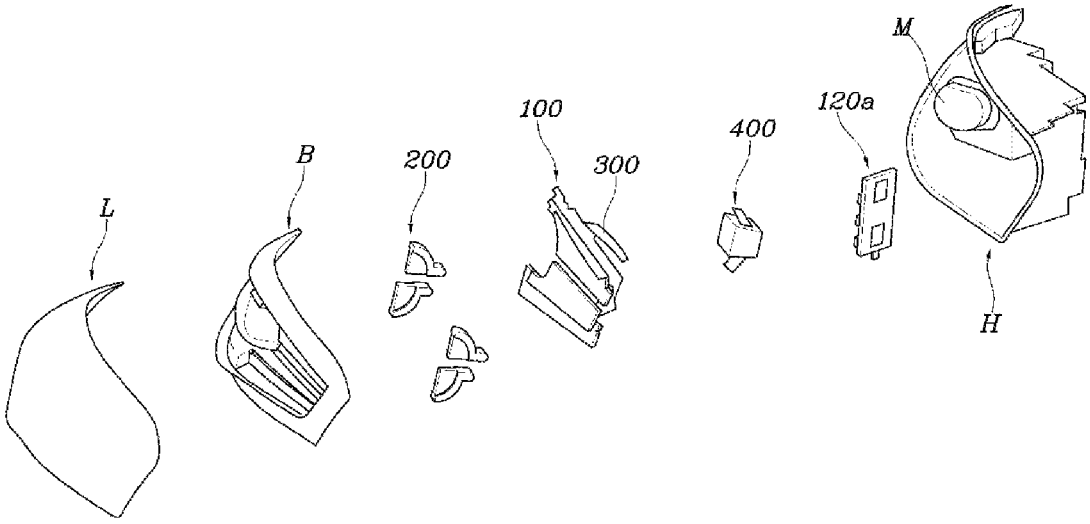
FIG. 1 is a exploded view illustrating parts of assembly of a headlamp.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

A variable headlamp apparatus for a vehicle according to exemplary forms of the present disclosure will be described below with reference to the accompanying drawings.

Figure 2:
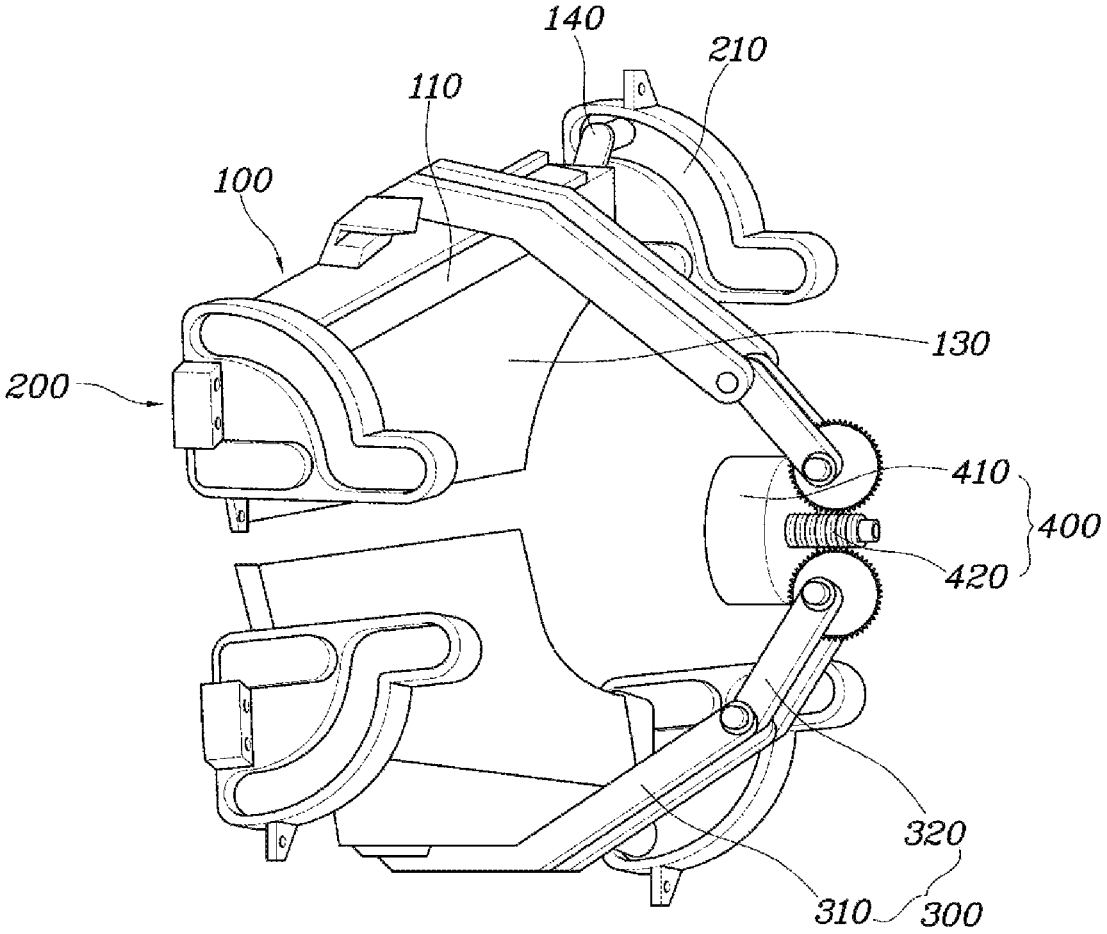
FIG. 2 is a view illustrating a variable headlamp apparatus for a vehicle.

FIG. 1 is a view illustrating a headlamp according to one form of the present disclosure. FIG. 2 is a view illustrating a variable headlamp apparatus for a vehicle according to one form of the present disclosure. FIGS. 3 to 9 are views for explaining the variable headlamp apparatus for a vehicle illustrated in FIG. 2.

As illustrated in FIGS. 1 and 2, the variable headlamp apparatus for a vehicle according to the present disclosure includes an optical unit 100 having a emitter 120 for emitting light; a guide unit 200 installed with the optical unit 100 and guiding the position of the optical unit 100 to a fixed path; a link unit 300 connected to the optical unit 100 and including a plurality of links rotatably connected to each other to change the position of the optical unit 100 depending on a rotation angle change between the links; and a drive unit 400 spaced apart from the guide unit 200, connected to the link unit 300, and transmitting rotational power during operation to rotate the links so that the optical unit 100 moves along the fixed path of the guide unit 200 for switching the light irradiation direction of the optical unit 100.

As described above, the present disclosure includes the optical unit 100, the guide unit 200, the link unit 300, and the drive unit 400, and they may be arranged in a headlamp housing H. The headlamp housing H may be provided with a separate headlamp module M, and a bezel B and a lens L may be coupled to the front of the headlamp housing H.

The optical unit 100 has the emitter 120 for emitting light. The optical unit 100 is installed to the guide unit 200 and is configured such that the position thereof is changed along the fixed path of the guide unit 200, thereby enabling the light irradiation direction of the optical unit 100 to be switched. The guide unit 200 may be fixed into the headlamp housing H.

The link unit 300 is connected to the optical unit 100 and is rotated by the rotational power transmitted from the drive unit 400 to change the position of the optical unit 100. That is, the links of the link unit 300 are rotated by the operation of the drive unit 400, and the optical unit 100 is moved in conjunction with the rotational movement of the links so that the position thereof is changed along the fixed path of the guide unit 200, thereby switching the light irradiation direction of the optical unit 100. Thus, it is possible to realize various lighting functions as the light irradiation direction is switched.

Figure 3:
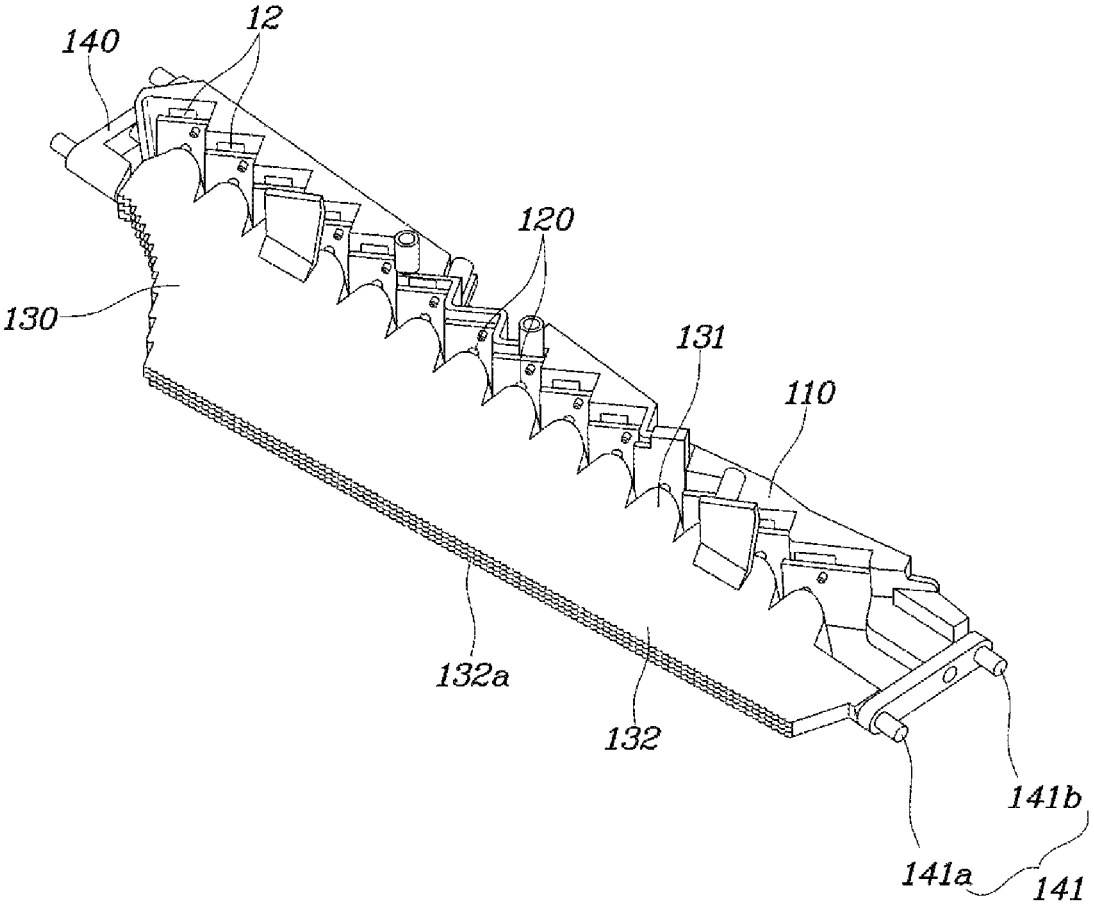
FIG. 3 is a view of illustrating an optical unit of the variable headlamp apparatus illustrated in FIG. 2.

The present disclosure will be described in detail. As illustrated in FIG. 3, the optical unit 100 includes an optical casing 110 installed with the emitter 120 for emitting light, and a projection lens 130 coupled to the optical casing 110 and disposed in the light irradiation direction of the emitter 120 so that the light incident thereon is emitted to the fixed path. The optical casing 110 may extend longitudinally, and has a heat sink 12 corresponding to the emitter 120 to radiate the heat transferred from the emitter 120. The projection lens 130 is coupled to the optical casing 110 so that the light emitted from the emitter 120 travels to the outside through the projection lens 130.

In detail, the projection lens 130 may extend in the light irradiation direction of the emitter 120 to have an end face and may include an incident part 131 on which light is incident from the emitter 120 and an emission part 132 from which light is emitted. The projection lens 130 may be a total internal reflection lens, and may extend in the longitudinal direction of the optical casing 110 to have an end face. Accordingly, when the light emitted from the emitter 120 is incident through the incident part 131 of the projection lens 130, the light may be irregularly reflected internally to travel toward the emission part 132 and then emitted to the outside through the emission part 132.

Figure 4:
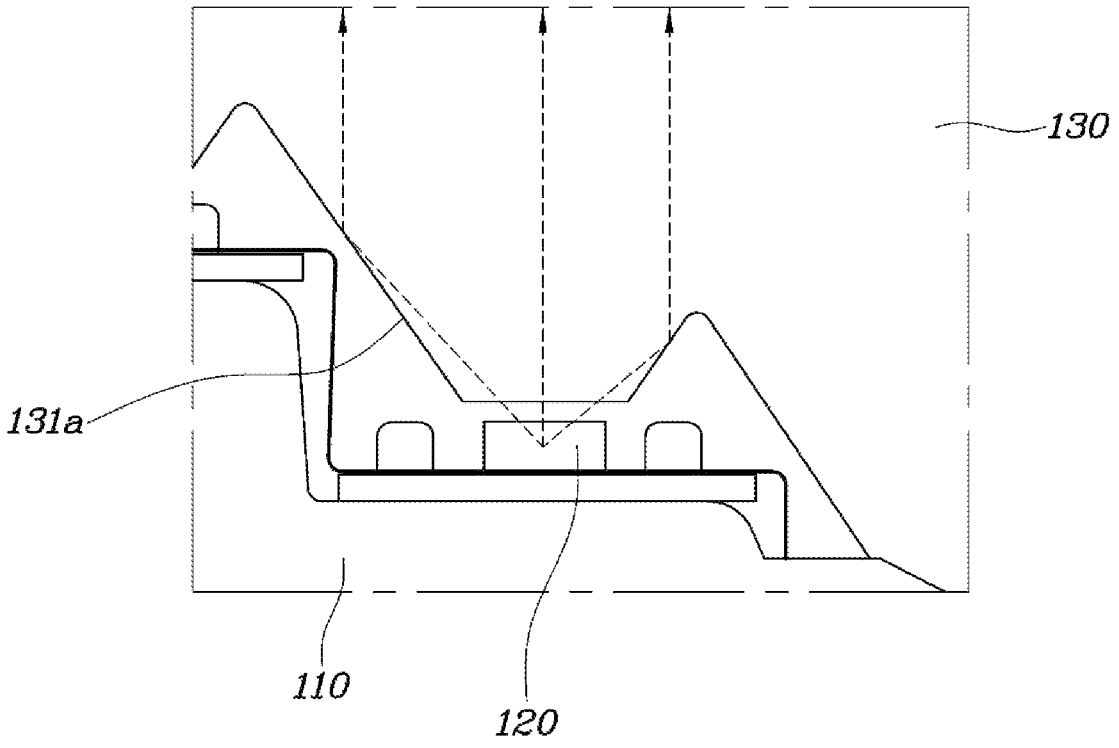
FIG. 4 is a view illustrating a light travel into projection lens by reflection.

The emitter 120 is composed of a plurality of LEDs arranged in the longitudinal direction of the optical casing 110. The incident part 131 of the projection lens 130 may be formed with a total reflection portion 131*a* which is matched to each of the LEDs and protrudes in a direction facing the emitter 120 to totally reflect incident light. Since the projection lens 130 has the total reflection portion 131*a* protruding adjacent to the associated LED from the incident part 131, the light emitted from the LED may be smoothly incident into the projection lens 130 through the total reflection portion 131*a*. To this end, as illustrated in FIG. 4, the total reflection portion 131*a* may be disposed horizontally with the LED of the emitter 120 and extend laterally at an angle, thereby enabling light to travel into the projection lens 130 by reflection.

Figure 5:
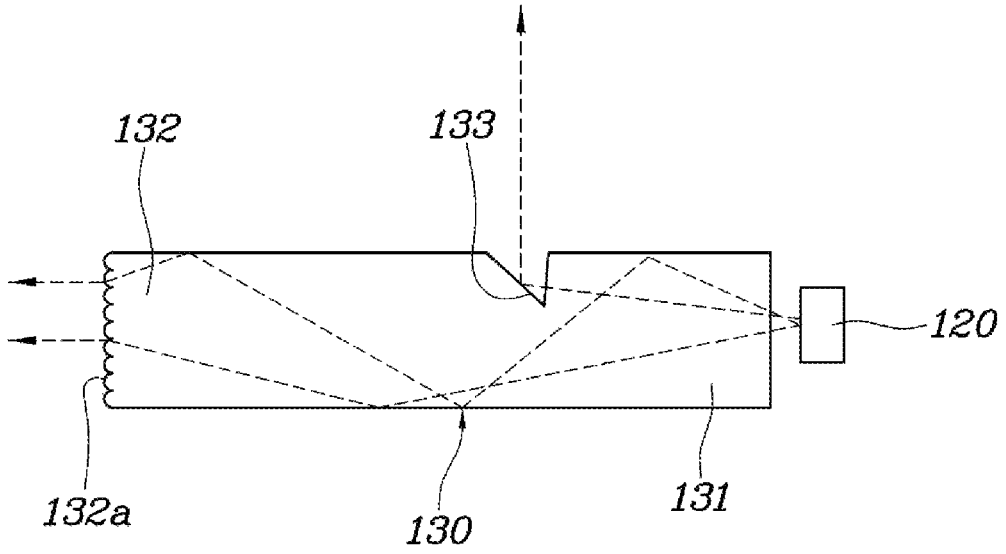
FIG. 5 is a virtual view illustrating a light travelling through an emission part.

As illustrated in FIG. 5, the emission part 132 of the projection lens 130 may have a plurality of optics 132*a* formed thereon, and a switching portion 133 may be recessed inward from the end face of the projection lens 130 to switch the traveling direction of some incident light. Thus, the light of the emitter 120 emitted through the emission part 132 of the projection lens 130 may be diffused and emitted by the optics 132*a*.

Since the switching portion 133 is recessed inward from the end face of the projection lens 130, the traveling path of some light incident into the projection lens 130 is switched by the switching portion 133. Thus, depending on the position of the optical unit 100, the light emitted from the emitter 120 is emitted to the outside through the emission part 132 of the projection lens 130 or through the switching portion 133, thereby enabling various lamp functions to be realized.

Figure 7:
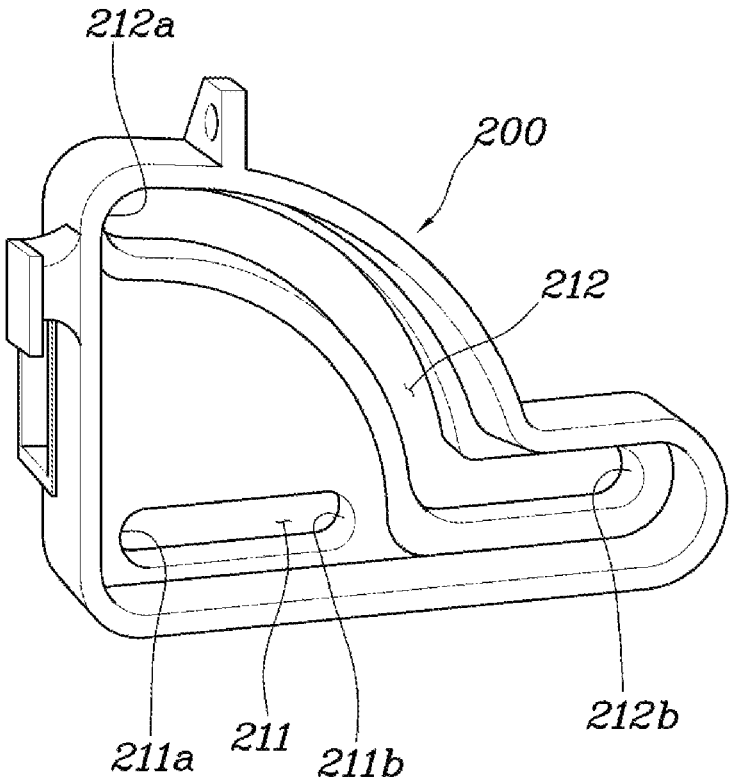
FIG. 7 is an enlarged view of a guide path formed in a guide unit.

As illustrated in FIGS. 3 and 7, the optical casing 110 is provided with a connection bracket 140 for allowing the projection lens 130 to be connected integrally thereto. The connection bracket 140 has a guide protrusion 141 protruding toward the guide unit 200, and the guide unit 200 may be formed with a guide path 210 so that the guide protrusion 141 is inserted into and slides in the guide path 210.

The optical casing 110 and the projection lens 130 are connected to each other through the connection bracket 140, and the connection bracket 140 consists of a pair of connection brackets coupled to both ends of each of the optical casing 110 and the projection lens 130, so that the optical casing 110 and the projection lens 130 are integrated. Since each of the connection brackets 140 has the guide protrusion 141 protruding therefrom and the guide unit 200 has the guide path 210 into which the guide protrusion 141 is inserted, the position of the optical unit 100 may be changed along with the connection bracket 140 as the guide protrusion 141 of the connection bracket 140 moves along the guide path 210.

Figure 6:
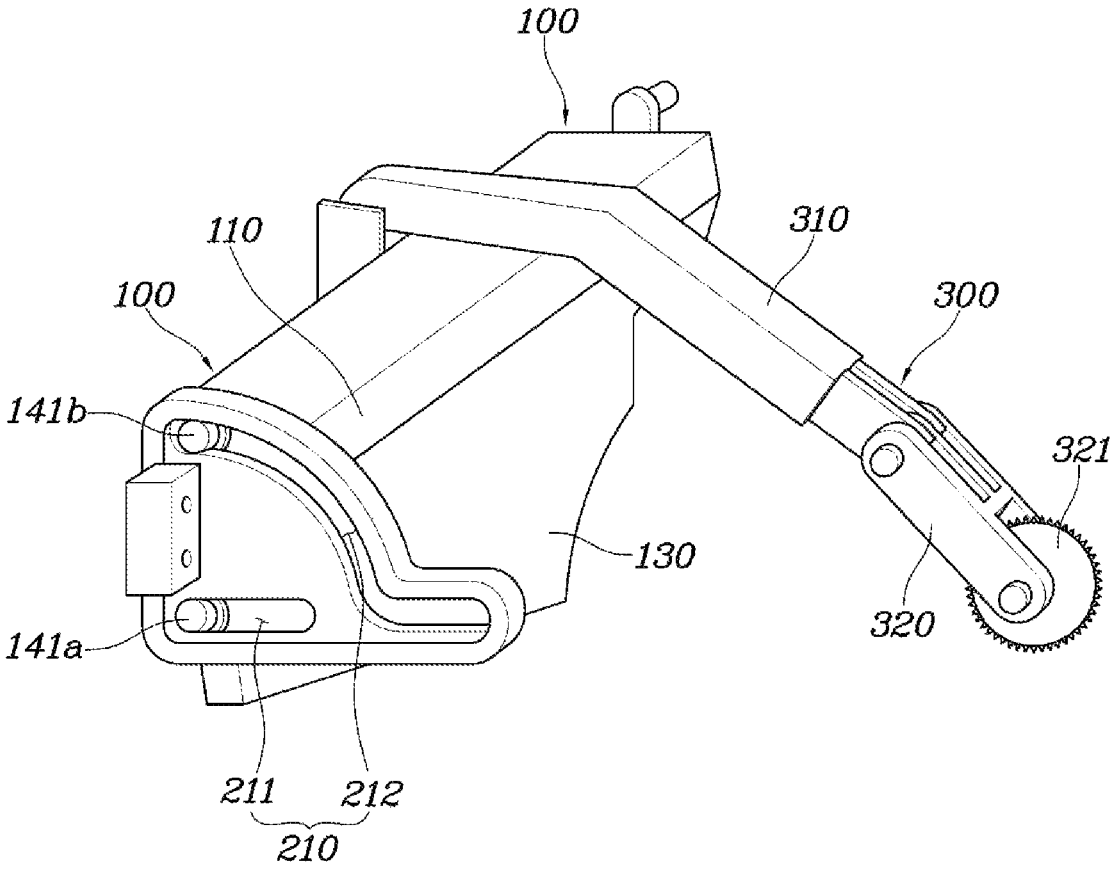
FIG. 6 is a perspective view illustrating an optical case provided with a connection bracket.

In detail, as illustrated in FIGS. 6 and 7, the guide path 210 of the guide unit 200 may have a first guide hole 211 extending in a straight line, and a second guide hole 212 spaced apart from the first guide hole 211 and extending in a curved line with a radius of curvature in the extension of the first guide hole 211. The guide protrusion 141 of the connection bracket 140 may have a first protrusion 141*a* inserted into the first guide hole 211 and a second protrusion 141*b* inserted into the second guide hole 212.

One end 212*a* of the second guide hole 212 may be spaced apart from one end 211*a* of the first guide hole 211 in a direction perpendicular to the extension of the first guide hole 211. The other end 212*b* of the second guide hole 212 may be disposed in the extension of the first guide hole 211 and spaced apart from the other end 211*b* of the first guide hole 211.

As illustrated in FIG. 7, the first guide hole 211 extends in a straight line and the second guide hole 212 consists of a curved portion and a straight portion extending from the first guide hole 211. Thus, the connection bracket 140 may rotate about the first protrusion 141*a* as the second protrusion 141*b* moves along the curved portion of the second guide hole 212 or may move linearly as the first protrusion 141*a* moves in the first guide hole 211 and the second protrusion 141*b* moves in the straight portion of the second guide hole 212.

Accordingly, the angle or position of the optical unit 100 having the connection bracket 140 is changed so that the light irradiation direction of the optical unit 100 is switched, thereby allowing for realization of various lighting functions.

The link unit 300 may include a first rotation link 310 rotatably connected to the optical casing 110 and a second rotation link 320 rotatably connected to the first rotation link 310 and rotated by the rotational power transmitted from the drive unit 400. The first rotation link 310 may extend in a curved line at an obtuse angle. The second rotation link 320 may extend in a straight line. The length of the first rotation link 310 is longer than that of the second rotation link 320.

The link unit 300 includes the first rotation link 310 and the second rotation link 320. The position of the optical unit 100 may be changed depending on the rotation angle change of the first and second rotation links 310 and 320. The first rotation link 310 extends in a curved line at an obtuse angle. Therefore, when the second rotation link 320 having a relatively short length rotates, the second protrusion 141*b* of the connection bracket 140 may smoothly move along the curved portion and straight portion of the second guide hole 212.

The shapes and lengths of the first and second rotation links 310 and 320 and the shapes and lengths of the first and second guide holes 211 and 212 may be set such that the optical unit 100 is rotated by 90° or moved rectilinearly.

The drive unit 400 may include a motor 410 that generates rotational power, and a screw 420 that extends from the motor 410, is rotated by the rotational power transmitted thereto, and has a thread formed thereon. The second rotation link 320 may have a rotary gear 321 engaged to the thread of the screw 420.

The motor 410 is rotatable in forward and reverse directions. Since the rotary gear 321 is simultaneously rotated along with the rotation of the screw 420 when the motor 410 is operated, the angle of rotation of the second rotation link 320 is changed together with the rotary gear 321. The rotary gear 321 is hinged to the headlamp housing H and allows rotation while the position thereof is fixed, and the second rotation link 320 is coupled to the rotary gear 321 to rotate together with the rotary gear 321. Thus, when the motor 410 is operated, the angle of rotation of the link unit 300 may be changed and the position of the optical unit 100 connected to the link unit 300 may be changed.

As illustrated in FIG. 2, the optical unit 100, the guide unit 200, and the link unit 300 are each provided in pair, which are spaced apart from each other, on the basis of the drive unit 400. The pair of link units 300 is connected to the single drive unit 400 so that the light irradiation directions of the respective optical units 100 may be simultaneously switched when the drive unit 400 is operated.

Since the plurality of optical units 100, guide units 200 and link units 300 are interlocked by the single drive unit 400, the manufacturing cost is reduced because there is no need for a plurality of the drive units 400. In addition, since various lighting functions are realized only by the single optical unit 100, it is possible to realize more various lighting functions by providing a plurality of optical units 100.

The structures of the optical units 100, the guide units 200, and the link units 300 are substantially the same, and the rotary gears 321 of the respective link units 300 are connected to the screw 420 of the single drive unit 400. Therefore, it is possible to switch the positions of the plurality of optical units 100.

The operation of the present disclosure will be described below.

In a specific lighting mode, some of the light emitted from the emitter 120 of the optical unit 100 is totally reflected by the projection lens 130 or reflected by the switching portion 133 of the projection lens 130 and is emitted to the outside, as illustrated in FIG. 6.

Figure 8:
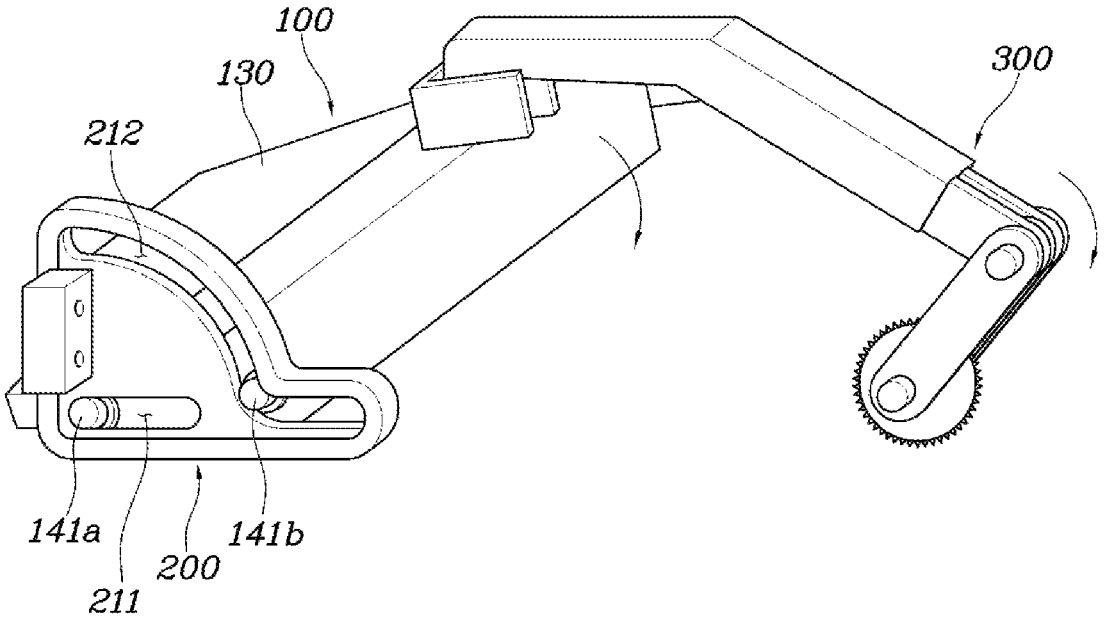
FIG. 8 is a view illustrating an operation of an optical unit and a motor in one form.

When the mode is switched to another lighting mode, the rotary gear 321 is rotated and the second rotation link 320 and the first rotation link 310 are rotated along with the rotary gear 321 by the operation of the motor 410 of the drive unit 400 so that the position of the optical unit 100 is changed, as illustrated in FIG. 8. In this case, the optical unit 100 may be rotated about the first protrusion 141*a* of the connection bracket 140 provided in the optical unit 100 as the second protrusion 141*b* moves along the second guide hole 212 of the guide unit 200.

Figure 9:
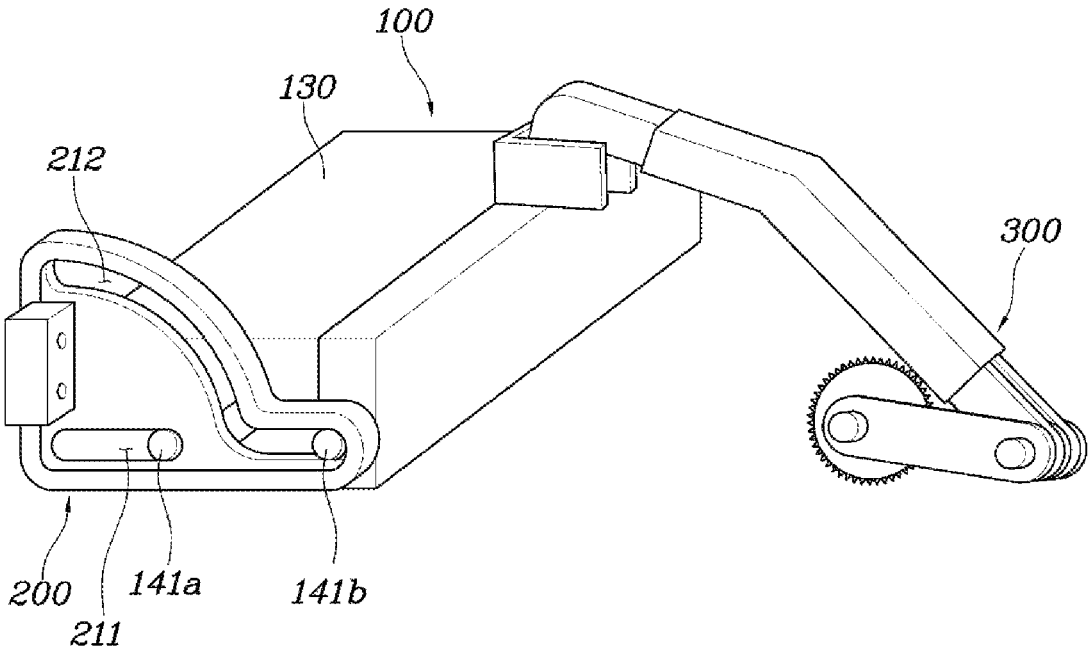
FIG. 9 is a view illustrating an operation of an optical unit and a motor in another form.

Then, when the motor 410 of the drive unit 400 continues to operate, the first protrusion 141*a* is rectilinearly moved in the first guide hole 211 and the second protrusion 141*b* is rectilinearly moved in the second guide hole 212, thereby allowing the position of the optical unit 100 to be fixed, as illustrated in FIG. 9. In addition, when a separate emitter for irradiating the optical unit 100 with light is further provided at a position where the optical unit 100 is completely moved in a straight line, it is possible to realize the lighting function in more various manners.

The variable headlamp apparatus for a vehicle having the above-mentioned structure can realize various lighting functions by switching the positions of the plurality of optical units only with the single drive unit, and achieve a reduction in manufacturing cost and a reduction in entire layout since there is no need for a plurality of drive units.

Although the exemplary forms of the present disclosure have been disclosed for illustrative purposes, those skilled in the art will appreciate that various modifications, additions and substitutions are possible, without departing from the scope and spirit of the present disclosure.

What is claimed is:

1. A variable headlamp apparatus for a vehicle, the variable headlamp apparatus comprising:

an optical unit having an emitter configured to emit light;

a guide unit installed with the optical unit and configured to guide a position of the optical unit to a fixed path;

a link unit connected to the optical unit and comprising a plurality of links rotatably connected to each other, and configured to change the position of the optical unit based on a change to a rotation angle formed by links of the plurality of links; and a drive unit spaced apart from the guide unit, connected to the link unit, and configured to transmit rotational power during operation and to rotate the links, wherein the optical unit is configured to move along the fixed path of the guide unit while switching a light irradiation direction of the emitter, wherein the optical unit comprises:

an optical casing installed with the emitter; and a projection lens coupled to the optical casing and disposed in the light irradiation direction of the emitter so that an incident light thereon is emitted to the fixed path, and wherein:

the optical casing is provided with a connection bracket configured to allow the projection lens to be connected integrally thereto, the connection bracket has a guide protrusion protruding toward the guide unit, the guide unit is formed with a guide path so that the guide protrusion is inserted into and slides in the guide path, the guide path of the guide unit has a first guide hole extending in a straight line, and a second guide hole spaced apart from the first guide hole, the second guide hole includes: a straight section extending in a straight line, and a curved section extending in a curved line with a radius of curvature, and connected with the straight section, and the guide protrusion of the connection bracket has a first protrusion inserted into the first guide hole and a second protrusion inserted into the second guide hole, the first protrusion and the second protrusion are configured to linearly move along the first guide hole and the straight section of the second guide hole, respectively.

2. The variable headlamp apparatus according to claim 1, wherein the projection lens is configured to extend in the light irradiation direction of the emitter to have an end face, and comprises an incident part on which light is incident from the emitter and an emission part from which light is emitted.

3. The variable headlamp apparatus according to claim 2, wherein:

the emitter comprises a plurality of light emitting diodes (LEDs) arranged in a longitudinal direction of the optical casing; and the incident part of the projection lens is formed with a total reflection portion that is matched to each of the LEDs and configured to protrude in a direction facing the emitter to totally reflect incident light.

4. The variable headlamp apparatus according to claim 2, wherein the emission part of the projection lens has a plurality of optics formed thereon, and a switching portion is recessed inward from the end face of the projection lens and configured to switch a traveling direction of some incident light.

5. The variable headlamp apparatus according to claim 1, wherein a first end of the second guide hole is spaced apart from a first end of the first guide hole in a direction perpendicular to the extension of the first guide hole, and a second end of the second guide hole is disposed in the extension of the first guide hole and spaced apart from a second end of the first guide hole.

6. The variable headlamp apparatus according to claim 1, wherein the link unit comprises a first rotation link rotatably connected to the optical casing, and a second rotation link rotatably connected to the first rotation link and rotated by rotational power transmitted from the drive unit.

7. The variable headlamp apparatus according to claim 6, wherein the first rotation link extends in a curved line, the second rotation link extends in a straight line, and the first rotation link has a length longer than the second rotation link.

8. The variable headlamp apparatus according to claim 6, wherein:

the drive unit comprises a motor that generates the rotational power, and a screw extended from the motor, which is rotated by the rotational power and has a thread formed thereon; and the second rotation link has a rotary gear engaged to the thread of the screw.

9. The variable headlamp apparatus according to claim 1, wherein:

the optical unit, the guide unit, and the link unit are each provided in pair, which are spaced apart from each other; and the pair of link units is connected to the drive unit so that light irradiation directions of the respective optical units are simultaneously switched when the drive unit is operated.

* * * * *